US006287741B1

(12) United States Patent
Marko

(10) Patent No.: US 6,287,741 B1
(45) Date of Patent: Sep. 11, 2001

(54) LIQUID TONER COMPOSITION

(75) Inventor: Herbert Lee Marko, Adelaide (AU)

(73) Assignee: Research Laboratories of Australia Pty Ltd, Eastwood (AU)

( * ) Notice: Subject to any disclaimer, the term of this patent is extended or adjusted under 35 U.S.C. 154(b) by 0 days.

(21) Appl. No.: 09/546,568

(22) Filed: Apr. 11, 2000

Related U.S. Application Data

(63) Continuation-in-part of application No. 09/389,478, filed on Sep. 3, 1999, now abandoned.

(51) Int. Cl.[7] ..... G03G 9/125; G03G 9/13
(52) U.S. Cl. ..... 430/115; 430/116
(58) Field of Search ..... 430/113, 114, 430/137, 115, 116

(56) References Cited

U.S. PATENT DOCUMENTS

| | | | | |
|---|---|---|---|---|
| 5,206,107 | * | 4/1993 | Pearlstine | 430/115 |
| 5,300,390 | * | 4/1994 | Landa et al. | 430/115 |
| 5,384,225 | * | 1/1995 | Kurotori et al. | 430/116 |
| 5,612,162 | * | 3/1997 | Lawson et al. | 430/113 |
| 6,137,976 | * | 10/2000 | Itaya et al. | 399/233 |

FOREIGN PATENT DOCUMENTS

| | | | | |
|---|---|---|---|---|
| 2-153363 | * | 6/1990 | (JP) | 430/115 |
| 3-68963 | * | 3/1991 | (JP) | 430/115 |
| 4-145452 | * | 5/1992 | (JP) | 430/115 |

* cited by examiner

*Primary Examiner*—John Goodrow
(74) *Attorney, Agent, or Firm*—Crowell & Moring LLP

(57) ABSTRACT

A liquid toner composition for use in high viscosity electrostatic printing processes. The liquid toner comprises a non-aqueous carrier liquid which is an electrically non-conductive liquid being a silicone fluid of straight chained or cyclic configuration, a silicone fluid of cyclic configuration, a silicone fluid of branched configuration, or a combination thereof having a viscosity in the range of from 0.5 to 1,000 mPa.s, an insoluble marking particle, and a dispersion additive, the dispersion additive comprising a polysiloxane having at least one functional group comprising a radical which introduces an active site into the polysiloxane and wherein the functional group is a radical selected from the group comprising a vinyl group, a carboxylic group, a hydroxyl group, or an amine group. The particular advantage of the liquid composition is that the formation of rivulets is minimised during printing with resultant improvement in image quality.

13 Claims, No Drawings

LIQUID TONER COMPOSITION

This applcation is a CIP or Ser. No. 09/389,478 Sep. 3, 1999 ABN.

FIELD OF THE INVENTION

This invention relates to liquid compositions suitable as toners and inks for non-impact printing.

BACKGROUND OF THE INVENTION

It has been recognised that certain properties of carrier fluids for liquid developers are required for effective functioning in conventional electrostatographic liquid development processes. Many of the physical requirements are mandatory, as known by those skilled in the art, but there are also other considerations, such as low toxicity, fire safety, low solvent power, low odour etc. For these reasons, isoparaffinic-hydrocarbons such as the Isopar range manufactured by Exxon Corporation, the Shellsol range manufactured by Shell Chemical and the Soltrol range manufactured by Phillips Petroleum became the industry standards for liquid toner carriers.

In more recent times, however, increased environmental concerns have placed liquid development processes under increasing pressure to further reduce or eliminate volatile emissions.

Other carrier materials applicable to liquid developers have been investigated and of these, silicone fluids are clearly liquids which combine all previously and currently desired properties of a modem liquid toner carrier.

In general, a liquid toner for developing electrostatic images is prepared by dispersing an inorganic or organic colorant such as iron oxide, carbon black, nigrosine, phthalocyanine blue, benzidine yellow, quinacridone pink and the like into a liquid vehicle which may contain dissolved or dispersed therein synthetic or naturally occurring polymers such as acrylics and their copolymers, alkyds, rosins, rosin esters, epoxies, polyvinyl acetate, styrene-butadiene, cyclised rubber, ethylene vinyl acetate copolymers, polyethylene, etc. Additionally, to impart or enhance an electrostatic charge on such dispersed particles, additives known as charge directors or charge control agents may be included. Such materials can be metallic soaps, fatty acids, lecithin, and the like.

Similarly an area of great interest exists in the development of liquid compositions for ink jet printing processes that employ environmentally friendly fluids as the carrier liquid. There are problems, however, with dispersion of marking particles such as organic pigments into such carrier liquids.

Silicone fluids have been used as carriers for liquid toners, eg. in U.S. Pat. No. 3,105,821 to S. W. Johnson, and U.S. Pat. No. 3,053,688 to H. G. Greig. Both of these early patents recognised the virtues of silicone fluids, but the understanding of the functioning of liquid toners at that time was relatively empirical, with those patents teaching simply the mechanical dispersion of a dry toner into the silicone fluid with no regard to chemical compatibility, which in turn governs the final particle size and stability of the dispersion so produced. More recently silicone fluids have again been recognised as desirable carrier fluids for liquid toners.

However, in the above application reliance is also placed on mechanical dispersion only. It is well known that silicone fluids have low solvent power for plastics and this property is well suited for copy machine components and organic photoconductor life. An unfortunate corollary to this is that many dispersion agents normally used in liquid toners, are incompatible with silicone fluids.

U.S. Pat. No. 5,612,162 to Lawson et al, as well as U.S. Pat. No. 5,591,557 to Lawson et al disclose compositions and methods of forming a liquid developer in silicone fluid. The teachings of these patents and formulations therein suffer from inadequate dispersion quality as required by high quality electrostatic printing. In particular, silicone fluid compatible dispersing agents are not employed in these formulations and consequently rivulet formation is a problem not addressed by these patents; such rivulets are manifest as disruptive localised areas of the continuous image and are similar to patterns observed when a high viscosity material is applied to flat surfaces as a thin film by means of a roller applicator.

It has been found that the particle size obtainable and the stability of dispersions of the prior art, have been inadequate due to the inability of the silicone fluid to fully disperse the marking particles sufficiently to achieve and maintain the required particle size during manufacture and use.

To further alleviate the environmental concerns as disclosed earlier, the concept of using high viscosity carrier fluids and or high solids content of the marking particles as liquid developers has been proposed. This type of liquid toner can develop an electrostatic latent image by use of a thin film of such highly concentrated liquid toners, within a process whereby these toners adhere selectively to the image part of an electrostatic latent image on an image bearing member without the toner adhering to the non-image part. This liquid developing method occurs by preferential adherence to the electrostatic latent image carrier surface under the dominant influence of the electric field strength of the electrostatic latent image, the quantity of toner transferred being proportional to the relative incremental field strength of the latent electrostatic image. This is a very high speed development method, in comparison to conventional liquid development which is solely reliant on electrophoretic migration along relatively large development gaps. An electrostatic printer utilising this type of high viscosity toner is described in Patent specification WO095/08792. With this concept however, a number of problems arise in relation to the liquid developer in such printing systems.

Such problems as the dispersion quality of the marking particles are apparent in printed copies from such non-impact printing devices using such liquid developers and are manifest as characters or areas of low optical density or poorly defined resolution with between such characters excessive background fog or background noise. The low optical density in many cases is related to the formation of so called rivulets.

This invention proposes an improvement in the dispersion quality of the marking particles thereby alleviating the problems noted above. In particular the problem of rivulet formation which is thought to be caused by the inadequate dispersion of marking particles such as pigments in a liquid developer is alleviated.

Such rivulet formation as so described can be readily seen in prints from a non-impact printing device such as an electrostatic printer of the type described in Patent specification WO095/08792. Although it must also be understood that such rivulet formation has been seen to detract from prints from other printing devices.

Thus the need exists for a method of minimising this rivulet formation by the inclusion of appropriate dispersion additives into preferred, high viscosity, high solids content liquid developers comprising liquid carriers which meet modem environmental demands and produce high quality prints with improved image resolution and higher optical density through the action of maintaining improved dispersion quality of the marking particles within the carrier liquid.

It is the object of this invention therefore, to provide an improved liquid toner composition which has additives which result in improved dispersion quality and thereby eliminating the formation of rivulets.

It is a further object of this invention to provide a liquid toner composition which has additives which result in improved particle size distribution, due to improved dispersion, as a result of increased steric stabilisation of the marking particles during manufacture, therefore inhibiting agglomeration during manufacture and for the life of the liquid developer.

It is a further object of this invention to provide a liquid toner composition which has additives which result in improved stability over a range of climatic conditions, and therefore having greatly improved shelf-life.

The liquid toner composition of this invention may be an ink for use in inkjet type printers, it may be a toner or liquid developer for electrostatography.

BRIEF DESCRIPTION OF THE INVENTION

In one form therefore the invention is said to reside in a liquid toner composition for use in electrostatic printing processes operating within the viscosity range of from 100 to 10,000 mPa.s, the liquid toner comprising;

(a) a non-aqueous carrier liquid, the carrier liquid being an electrically non-conductive liquid selected from the group comprising a silicone fluid of straight chained configuration, a silicone fluid of cyclic configuration, a silicone fluid of branched configuration, or a combination thereof having a viscosity in the range of from 0.5 to 1,000 mPa.s.

(b) an insoluble marking particle, and (c) a dispersion additive, the dispersion additive comprising a polysiloxane having at least one functional group comprising a radical which introduces an active site into the polysiloxane and wherein the functional group is a radical selected from the group comprising a vinyl group, a carboxylic group, a hydroxyl group, or an amine group, whereby the formation of rivulets is minimised during printing with resultant improvement in image quality Preferably the polysiloxane dispersion agent is selected from the group comprising a straight chain polysiloxane or a cyclic polysiloxane or a branched polysiloxane, or a combination thereof. The viscosity of the polysiloxane dispersion additive may be up to 90,000 mPa.s.

The polysiloxane dispersion agent may be a polysiloxane polymer represented by the following general structure:

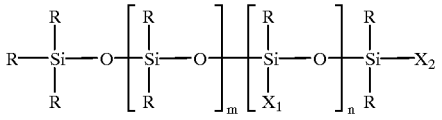

where R represents an alkyl ($—CH_3$) group or a hydroxyl group (—OH) and $X_1$ and $X_2$ represent functional groups with:

(1) Amine functionality (—NH2)

(2) Carboxylic acid functionality (—COOH)

(3) Vinyl functionality ($—CH{=}CH_2$)

(4) Hydroxyl functionality (—OH)

(5) Alkyl functionality ($—CH_3$), but wherein either $X_1$ or $X_2$ also contains a functionality selected from (1) to (4) above.

(6) An alkyl group containing a functional group selected from (1) to (4) above, with appropriate stoichiometry, ie:

—RX
—RXR
—RXRX
—XR
—XRX
—XRXR where X is a functional group selected from (1) to (4) above and R is an alkyl group.

The marking particle may be selected from the group comprising a pigment, a polymeric resin, ferromagnetic particles and luminescent particles and the marking particle concentration may be up to 40% by weight. The insoluble marking particle may be a modified epoxy polymer, the polymer being a reaction product of an epoxy resin and nitrogen bearing polymeric compound. The nitrogen bearing polymeric compound may be an alkylated polyvinylpyrrolidone.

Where the marking particle is a pigment the marking particle may be coated with the modified epoxy polymer.

Preferably the modified epoxy polymer is blended with a pigment and then extruded.

The liquid composition according to this invention may further include one or more additional components selected from the group comprising dyestuffs, curing agents, bacteriostats, charge control agents and anti-oxidants.

DETAILED DESCRIPTION OF THE INVENTION

We have found that improved print performance can be achieved with the dispersion agent of the present invention. Particularly, high viscosity silicone fluid carrier liquids often possess inherent problems and it has been found that the incorporation of the dispersion agent of the present invention has provided improvements which include rivulet formation on the printed images being greatly reduced, dispersion quality being greatly improved, liquid is not abstracted from the marking particles in the dispersions, image density is greatly increased and smoothness of image is improved.

One explanation for the improvements of the type discussed above, to which the applicants do not wish to be bound, is that the active sites provided by the functional groups of the polymeric polysiloxane dispersion additives may bind or adsorb to the surface of the marking particles thereby providing the particles with an external physical polymeric barrier or so-called "tail" that is carrier fluid compatible thereby preventing agglomeration of the particles through the mechanism of steric stabilisation, resulting in improved dispersion and consequently giving the improvements discussed above. It is also believed that the dispersion additives of the present invention may contribute to increasing the ionic stabilisation of the marking particles by effectively increasing the charge repulsion between particles.

We have found that greatly improved print performance can be achieved with the dispersion agent of the present invention with liquid compositions comprising a silicone fluid carrier with a viscosity in the order of 0.5–1,000 mPa.s., preferably 20–500 mPa.s. The concentration of the marking particles within the liquid developer can be up to 40% by weight, preferably 10–25%. Such a liquid developer may exhibit a viscosity in the order of 100–10,000 mPa.s, preferably 200–1,000 mPa.s.

In particular, compositions with a high concentration of marking particles in a silicone fluid, were found to achieve good print performance in an electrostatic printer in comparison to compositions without the dispersion agent. It has been found that the incorporation of the dispersion agent of the present invention has provided further improvements which include rivulet formation on the printed images being greatly reduced, dispersion quality being greatly improved, liquid is not abstracted from the marking particles in the dispersions, image density is greatly increased and smoothness of image improved.

An additional benefit was found that the average particle size distribution of the liquid developers are also effectively reduced indicating the achievement of more efficient dispersion and therefore milling of the marking particles during manufacture. The dispersion additive further acts to greatly reduce the reagglomeration of particles after milling by providing the dispersion with sufficient steric stabilisation to maintain an optimised liquid developer.

The dispersing agent may be incorporated into the liquid composition by techniques commonly employed in the manufacture of liquid compositions such as: ball-jar milling, attritor milling, bead milling etc. Pre-mixing techniques involving blending the dispersion agent into the carrier liquid before the addition of marking particles and before the milling stage can also be used to incorporate the dispersion additive into the liquid developer formulation.

The dispersion additive also effectively improves dispersion quality for liquid developers manufactured by non-milling/grinding techniques, such as a liquid developers produced by hot melt emulsification (U.S. Pat. No. 5,609,979, Spheroidal Particles Useful for Electrostatography by T. M. Lawson).

This then generally describes the invention but to assist with understanding reference will now be made to a number of examples and comparisons which show the efficacy of the dispersion agent of the present invention in a variety of compositions.

The various examples were tested using an electrostatic printer of the type described in Patent specification WO095/08792.

COMPARISONS AND EXAMPLES

The following comparisons and examples are presented to define the invention more fully without any intention of being limited thereby. The following formulations may include a charge director. Charge directors as known to those skilled in the art can be added to impart a charge on the marking particles as required. All formulation examples listed below were prepared by adding the constituents of each example into a ceramic ball jar containing spherical ceramic grinding media and milling for 4 days to prepare a resinous toner. It should be understood that the quantities of raw materials in the Examples can be varied dependent on the liquid developer characteristics required and the mode of operation of the electrostatic printer. The formulations were then examined for print quality by producing images with the electrostatic printer as dicussed above.

| | | |
|---|---|---|
| **COMPARISON 1** | | |
| Araldite 6084 | crushed | 96 g |
| Irgalite Blue LGLD | | 24 g |
| Nuxtra 6% Zirconium | | 6 g |
| DC 200 Fluid | 20 cSt | 474 g |
| **EXAMPLE 1** | | |
| Araldite 6084 | crushed | 96 g |
| Irgalite Blue LGLD | | 24 g |
| Nuxtra 6% Zirconium | | 6 g |
| Elastosil M4640A | | 60 g |
| DC 200 Fluid | 20 cSt | 414 g |
| **EXAMPLE 2** | | |
| Araldite 6084 | crushed | 96 g |
| Irgalite Blue LGLD | | 24 g |
| Nuxtra 6% Zirconium | | 6 g |
| Elastosil M4640A | | 150 g |
| DC 200 Fluid | 20 cSt | 324 g |
| **COMPARISON 2** | | |
| Araldite 6084 | crushed | 96 g |
| Irgalite Blue LGLD | | 24 g |
| Nuxtra 6% Zirconium | | 6 g |
| DC 345 Fluid | | 474 g |
| **EXAMPLE 3** | | |
| Araldite 6084 | crushed | 96 g |
| Irgalite Blue LGLD | | 24 g |
| Nuxtra 6% Zirconium | | 6 g |
| Elastosil M4640A | | 60 g |
| DC 345 Fluid | | 414 g |
| **EXAMPLE 4** | | |
| Araldite 6084 | crushed | 96 g |
| Irgalite Blue LGLD | | 24 g |
| Nuxtra 6% Zirconium | | 6 g |
| Elastosil M4640A | | 150 g |
| DC 345 Fluid | | 324 g |

Elastosil M4640A is a polysiloxane having a vinyl functional group made by Wacker Chemicals, Munich Germany. Araldite 6084 is an epoxy resin made by Ciba-Geigy, Basel Switzerland. Irgalite Blue LGLD is a CI Pigment Blue 15:3 made by Ciba-Geigy, Basel Switzerland. Nuxtra 6% Zirconium is a zirconium octoate made by Creanova, New Jersey U.S.A. DC200 20cSt Fluid and DC345 Fluid are silicone oils made by Dow Coming, U.S.A For each of the examples standard test prints were prepared. Optical density measurements were taken with a Gretag, D186 densitometer. Measurements of the average maximum optical density in 100% solid image areas and also an average background (background fog or noise) optical density for all examples were taken and the overall image quality was also evaluated.

Comparison 1 and Example 1 and Example 2 demonstrated the beneficial effect of one of the preferred dispersion agents. The carrier liquid employed in these formulations is a Dow Coming silicone fluid known as DC 200 20cSt fluid. The image quality of these prints was greatly improved as the quantity of dispersion agent was increased. In summary, as the amount of dispersion agent increases in this formulation series, ie Comparison 1 to Example 1 to Example 2, the following trends were noticed:

Rivulet formation is greatly reduced

Optical image density is greatly increased

Overall image smoothness is greatly improved

Comparison 2 and Example 3 and Example 4, formulations employing the non-volatile cyclic silicone fluid carrier liquid DC345 fluid, demonstrated the same trend as explained above.

The effectiveness of the dispersion agent in different carrier fluids has been illustrated with Examples 1–4. However, in these print sample there was an observable trend of increased background fog or noise with increased dispersion agent concentration. This effect can be attributed to the higher dispersion quality achieved with increasing dispersion agent; for as dispersion quality increases, particle size and agglomeration tendency decreases, resulting in a substantial population of toner "fines" (primarily pigment fines) being available for development in the background areas.

Consequently, a method to eliminate background fog with the improved dispersion quality liquid compositions has been developed. As the fines are primarily pigment, this can be overcome by resin coating the pigment surface, by extruding (or other techniques known to the art of resin coating pigment) the pigment and resin together (to produce Extrudate 1) prior to adding them to the ball jar for milling.

| Extrudate 1 | |
|---|---|
| Araldite 6084 | 80 g |
| Irgalite Blue LGLD | 20 g |

The formulation example listed below demonstrates the effectiveness of this technique and was prepared by adding the constituents of the example (Example 11) into a ceramic ball jar containing spherical ceramic grinding media and milling for 7 days to prepare a resinous toner. The formulation was then examined for print quality by producing an image with the electrostatic printer as discussed above.

| EXAMPLE 5 | | |
|---|---|---|
| Extrudate 1 | | 125 g |
| Finish WR1101 | | 5 g |
| DC 200 Fluid | 100 cSt | 370 g |

Finish WR1101 is a polysiloxane having an amine functional group, made by Wacker Chemicals, Munich Germany. DC 200 100cSt Fluid is a silicone fluid made by Dow Coming, U.S.A.

With the above example 5, it was surprisingly found that the use of Finish WR1101 contributed so significantly to marking particle charging that the use of an additional charge control agent was not required.

Furthermore, the dispersion strength of the Finish WR1101 was found to be superior to that of the previously used Elastosil M4640A and it could therefore be used in far lesser quantities while still maintaining the desirable dispersion attributes of these materials.

The improvement in dispersion strength is believed to be due to the increased surface activity associated with the amine functional Finish WR1101 compared to that of the vinyl functional Elastosil M4640A.

The results of this formulation showed that resin coating the pigment has resulted in maintaining the improved image quality effects associated with the dispersion additive, while also eliminating any background density. The overall print quality results could be summarised as follows:

Rivulet formation was greatly reduced.

Optical image density was greatly increased.

Overall image smoothness was greatly improved.

Background image density was eliminated.

Use of the dispersion additive is not restricted to epoxy resin based systems. Dispersion quality and therefore image quality is greatly improved with the addition of these dispersion additives to either pigment/resin extruded or unextruded formulations which employ other synthetic or naturally occurring polymers such as, acrylics, polyesters, and their copolymers, alkyds, rosins, rosin esters, other epoxies or modified epoxies, polyvinyl acetate, styrene-butadiene, cyclised rubber, ethylene vinyl acetate copolymers, polyethylene etc.

In fact, a preferred embodiment consists of an extruded, pigment—modified epoxy formulation. The epoxy resin is modified by reacting it with an alkylated polyvinylpyrrolidone to produce a new thermoplastic resin which is then extruded with the pigment. For convenience we can label this modified epoxy resin coated pigment as Extrudate 2 as illustrated in the following Example 6.

The composition of Extrudate 2 is:

| Extrudate 2 | |
|---|---|
| Araldite GT6084 | 61.5 g |
| Antaron V220 | 18.5 g |
| Irgalite Blue LGLD | 20 g |

Antaron V220 is an alkylated polyvinylpyrrolidone made by GAF/ISP Chemicals, New Jersey U.S.A.

| EXAMPLE 6 | | |
|---|---|---|
| Extrudate 2 | | 125 g |
| Finish WR1101 | | 5 g |
| DC 200 Fluid | 100 cSt | 370 g |

With the above example 6, it was found that the use of Finish WR1101 contributed to marking particle charging so that the use of an additional charge control agent was not required.

Furthermore, the dispersion strength of the Finish WR1101 was found to be superior to that of the previously used Elastosil M4640A and it could therefore be used in lesser quantities while still maintaining the desirable dispersion attributes of these materials.

The improvement in dispersion strength is believed to be due to the increased surface activity associated with the amine functional Finish WR1101 compared to that of the vinyl functional Elastosil M4640A.

A standard print sample for Example 6 demonstrated the effectiveness of the dispersion agent by showing excellent image quality no rivulet formation, high maximum optical density and zero background fog or noise density.

The following examples 13 to 15 further illustrate formulations which demonstrate the excellent image quality obtained in the noted electrostatic printer.

The composition of Extrudate 3 is:

| Extrudate 3 | |
|---|---|
| Araldite 6084 | 61.5 g |
| Antaron V220 | 18.5 g |
| Tintacarb 435 | 20 g |

Tintacarb is a CI Pigment Black 7 made by Cabot Corporation, Australia.

| EXAMPLE 7 | | |
|---|---|---|
| Extrudate 3 | | 120 g |
| Nuxtra 6% Zirconium | | 4 g |
| Elastosil M4640A | | 120 g |
| DC 200 Fluid | 20 cSt | 356 g |

A standard print sample for Example 7 demonstrated the effectiveness of the dispersion agent by showing excellent image quality no rivulet formation, high maximum optical density and zero background fog or noise density.

The composition of Extrudate 4 is:

| Extrudate 4 | |
|---|---|
| Araldite 6084 | 61.5 g |
| Antaron V220 | 18.5 g |
| Irgalite Rubine LB4N | 20 g |

Irgalite Rubine is a CI Pigment Red 57 made by Ciba-Geigy, Basel Switzerland.

| EXAMPLE 8 | | |
|---|---|---|
| Extrudate 4 | | 120 g |
| Nuxtra 6% Zirconium | | 4 g |
| Elastosil M4640 A | | 120 g |
| DC 200 Fluid | 20 cSt | 356 g |

A standard print sample for Example 8 demonstrated the effectiveness of the dispersion agent by showing excellent image quality no rivulet formation, high maximum optical density and zero background fog or noise density.

The composition of Extrudate 5 is:

| Extrudate 5 | |
|---|---|
| Araldite GT6084 | 61.5 g |
| Antaron V220 | 18.5 g |
| Monolite Yellow GNA | 20 g |

Monolite Yellow is a CI Pigment Yellow 1 made by ICI Australia, Australia.

| EXAMPLE 9 | | |
|---|---|---|
| Extrudate 5 | | 120 g |
| Nuxtra 6% Zirconium | | 4 g |
| Elastosil M4640 A | | 120 g |
| DC 200 Fluid | 20 cSt | 356 g |

A standard print sample for Example 9 demonstrated the effectiveness of the dispersion agent by showing excellent image quality no rivulet formation, high maximum optical density and zero background fog or noise density.

Comparison of Particle Size Reduction Effects of Dispersion Additive.

The formulation examples listed below demonstrate the improved dispersion quality and particle size reduction achieved by using the dispersion additive during the milling stage compared to the same formulation without the dispersion additive for the liquid compositions employing the preferred pigment/ resin system, that is Extrudate 2 to Extrudate 5. In the following examples and comparison Extrudate 2 was used. The liquid compositions were prepared by adding the constituents of each example into a ceramic ball jar containing spherical ceramic grinding media and milling for 7 days to prepare a resinous toner. The formulations were then examined for print quality by producing images with the electrostatic printer as previously described.

| EXAMPLE 10 | | |
|---|---|---|
| Extrudate 2 | | 120 g |
| Nuxtra 6% Zirconium | | 4 g |
| Elastosil M4640A | | 60 g |
| DC 200 Fluid | 20 cSt | 416 g |
| **EXAMPLE 11** | | |
| Extrudate 2 | | 120 g |
| Nuxtra 6% Zirconium | | 4 g |
| Elastosil M4640 A | | 120 g |
| DC 200 Fluid | 20 cSt | 356 g |
| **COMPARISON 3** | | |
| Extrudate 2 | | 120 g |
| Nuxtra 6% zirconium | | 4 g |
| DC 200 Fluid | 20 cSt | 476 g |

Standard print samples for Example 10 and 11 demonstrated the effectiveness of the dispersion agent by showing excellent image quality no rivulet formation, high maximum optical density and zero background fog or noise density, and effectively reducing particle size as detailed in Table 1. Comparison 3 however, demonstrated overall poorer image quality and larger mean particle size diameters as detailed in Table 1. The results here indicate how resin coating the pigment has resulted in maintaining the improved image quality effects associated with the dispersion additive, while also minimising background density and effectively reducing particle size as detailed in Table 1.

TABLE 1

Mean diameters from the particle size distribution curves.

| Composition | Dispersion Additive weight % | Mean Particle Size Diameters (μm) D(v, 0.5) | D(4, 3) |
|---|---|---|---|
| Example 11 | 20 | 0.79 | 1.28 |
| Example 10 | 10 | 1.15 | 1.68 |
| Comparison 3 | 0 | 1.79 | 2.23 |

The above particle size results were characterised using a Malvem Mastersizer S. D(4,3) indicates the equivalent spherical volume diameter mean. This value is biased toward larger particles since volume is a function of the cube of the particle radius. D(v,0.5) indicates the volume 50% value of the distribution. This differs from D(4,3) if the volume distribution is skewed.

Examples of Other Functional Group Polysiloxane Dispersion Additives.

Formulations utlising polysiloxanes as dispersing agents for various liquid developer formulations have been investigated. These polysiloxane dispersing agents, possess at least one functional group, for example, a vinyl group, a carboxylic acid group, hydroxyl group or an amine group.

Other liquid composition formulations that utilise different polysiloxane dispersion additives that demonstrate similar improved dispersion and image quality, are given below. These formulations are based on utilising one of the preferred Extrudates, Extrudate 2 in the following examples, as the marking particle. The liquid compositions were prepared by adding the constituents of each example into a ceramic ball jar containing spherical ceramic grinding media and milling for 7 days to prepare a blue resinous toner. The formulations were then examined for print quality by producing images with the electrostatic printer as previously described.

| | | |
|---|---|---|
| EXAMPLE 12 | | |
| Extrudate 2 | | 120 g |
| Nuxtra 6% Zirconium | | 4 g |
| Elastosil M4600A | | 120 g |
| DC 200 Fluid | 20 cSt | 356 g |
| EXAMPLE 13 | | |
| Extrudate 2 | | 120 g |
| Nuxtra 6% Zirconium | | 4 g |
| Finish WR1101 | | 60 g |
| DC 200 Fluid | 20 cSt | 416 g |
| EXAMPLE 14 | | |
| Extrudate 2 | | 120 g |
| Nuxtra 6% Zirconium | | 4 g |
| Elastosil LR 3003/10 A | | 90 g |
| DC 200 Fluid | 20 cSt | 386 g |

Elastosil M4600A is a polysiloxane having a vinyl functional group, Finish WR1101 is a polysiloxane having an amine functional group, Elastosil LR 3003/10A is a polysiloxane having an hydroxyl functional group, all being made by Wacker Chemicals, Munich Germany.

Examples 12 to 14 also demonstrated the effectiveness of different functional group polysiloxane dispersion additives by showing good image quality with no rivulet formation, high maximum optical density and zero background density.

It has also been found that the liquid toner compositions of this invention have demonstrated great stability over a range of environmental conditions, and hence demonstrated a long shelf-life; as determined by accelerated age testing, viscosity and particle size analysis, and other pertinent test procedures as is known in the art. Excellent resistance to temperature variations, in the range of 20° C. to 60° C. was exhibited by the liquid developer compositions of this invention, therefore allowing minimal disturbance to the liquid toner stability under possible extreme operational and transportation conditions.

What is claimed:

1. A liquid toner composition for use in electrostatic printing processes operating within the viscosity range of from 100 to 10,000 mPa.s, the liquid toner comprising:

(a) a non-aqueous carrier liquid, the carrier liquid being an electricaly non-conductive liquid selected from the group consisting of a silicon fluid of straight chained configuration, a silicone fluid of cyclic configuration, a silicone fluid of branched configuration, and a combination thereof having a viscosity in the range of from 0.5 to 1,000 mPa.s;

(b) an insoluble marking particle, and (c) a dispersion additive, the dispersion additive comprising a polysiloxane having at least one functional group comprising a radical which introduces an active site into the poly-siloxane and wherein the functional group is a radical selected from the group consisting of a vinyl group, a carboxylic group, a hydroxyl group, and an amine group, whereby the formation of rivulets is minimised during printing with resultant improvement in image quality.

2. A liquid composition as in claim 1 wherein the polysiloxane dispersion agent is selected from the group consisting of a straight chain polysiloxane, a cyclic polysiloxane, a branched polysiloxane, and a combination thereof.

3. A liquid composition as in claim 1 wherein the viscosity of the polysiloxane dispersion additive is up to 90,000 mPa.s.

4. A liquid composition as in claim 1 wherein the polysiloxane dispersion agent is a polysiloxane polymer represented by the following general structure:

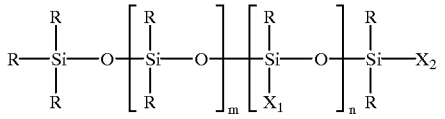

where R represents an alkyl (—$CH_3$) group or a hydroxyl group (—OH) and $X_1$ and $X_2$ represent functional groups with:

(1) Amine functionality (—$NH_2$)

(2) Carboxylic acid functionality(—COOH)

(3) Vinyl functionality (—CH═$CH_2$)

(4) Hydroxyl functionality (—OH)

(5) Alkyl functionality (—$CH_3$), but wherein either $X_1$ or $X_2$ also contains a functionality selected from (1) to (4) above.

(6) An alkyl group containing a functional group selected from (1) to (4) above, with appropriate stoichiometry, ie:

—RX

—RXR

—RXRX

—XR

—XRX

—XRXR where X is a functional group selected from (1) to (4) above and R is an alkyl group.

5. A liquid composition as in claim 1 wherein the marking particle is selected from the group consisting of a pigment, a polymeric resin, ferromagnetic particles and luminescent particles.

6. A liquid composition as in claim 1 wherein the marking particle concentration is up to 40% by weight.

7. A liquid composition as in claim 1 wherein the insoluble marking particle is a modified epoxy polymer, the polymer being a reaction product of an epoxy resin and nitrogen bearing polymeric compound.

8. A liquid composition as in claim 7 wherein the nitrogen bearing polymeric compound is an alkylated polyvinylpyrrolidone.

9. A liquid composition as in claim 7 wherein a pigment is coated with the modified epoxy polymer.

10. A liquid composition as in claim 7 wherein the modified epoxy polymer is blended with a pigment and then extruded.

11. A liquid composition as in claim 1 wherein the liquid composition further includes one or more additional components selected from the group comprising dyestuffs, curing agents, bacteriostats, charge control agents and antioxidants.

12. A liquid composition as in claim 2 wherein the polysiloxane dispersion agent is a polysiloxane polymer represented by the following general structure:

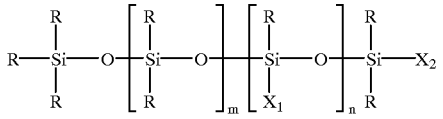

where R represents an alkyl (—$CH_3$) group or a hydroxyl group (—OH) and $X_1$ and $X_2$ represent functional groups with:

(1) Amine functionality (—$NH_2$)

(2) Carboxylic acid functionality (—COOH)

(3) Vinyl functionality (—CH═$CH_2$)

(4) Hydroxyl functionality (—OH)

(5) Alkyl functonality (—$CH_3$), but wherein either $X_1$ or $X_2$ also contains a functionality selected from (1) to (4) above.

(6) An alkyl group containing a functional group selected from (1) to (4) above, with appropriate stoichiometry, ie:

—RX

—RXR

—RXRX

—XR

—XRX

—XRXR where X is a functional group selected from (1) to (4) above and R is an alkyl group.

13. A liquid composition as in claim 3 wherein the polysiloxane dispersion agent is a polysiloxane polymer represented by the following general structure:

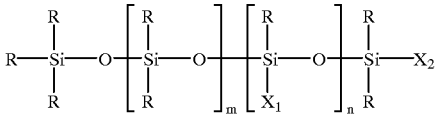

where R represents an alkyl (—$CH_3$) group or a hydroxyl group (—OH) and $X_1$ and $X_2$ represent functional groups with:

(1) Amine functionality (—$NH_2$)

(2) Carboxylic acid functionality (—COOH)

(3) Vinyl functionality (—CH═$CH_2$)

(4) Hydroxyl functionality (—OH)

(5) Alkyl functionality (—$CH_3$), but wherein either $X_1$ or $X_2$ also contains a functionality selected from (1) to (4) above (6) An alkyl group containing a functional group selected from (1) to (4) above, with appropriate stoichiometry, ie:

—RX

—RXR

—RXRX

—XR

—XRX

—XRXR where X is a functional group selected from (1) to (4) above and R is an alkyl group.

* * * * *